US011710606B2

(12) United States Patent
Belisle et al.

(10) Patent No.: US 11,710,606 B2
(45) **Date of Patent: *Jul. 25, 2023**

(54) DUAL PARALLEL MOVEABLE ELECTRICAL CONTACTS/RELAYS

(71) Applicant: Hamilton Sundstrand Corporation, Charlotte, NC (US)

(72) Inventors: Francis C. Belisle, Beloit, WI (US); David M. Kucharski, Delavan, WI (US); Joshua C. Swenson, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/399,180

(22) Filed: Aug. 11, 2021

(65) Prior Publication Data

US 2022/0013307 A1 Jan. 13, 2022

Related U.S. Application Data

(63) Continuation of application No. 16/701,568, filed on Dec. 3, 2019, now Pat. No. 11,195,671.

(51) Int. Cl.

| | |
|---|---|
| ***H01H 1/20*** | (2006.01) |
| ***H01H 3/28*** | (2006.01) |
| ***H01H 3/38*** | (2006.01) |

(52) U.S. Cl.

CPC ..... *H01H 1/2025* (2013.01); *H01H 3/28* (2013.01); *H01H 3/38* (2013.01); (Continued)

(58) Field of Classification Search

USPC ..... 335/71

See application file for complete search history.

(56) References Cited

U.S. PATENT DOCUMENTS

| | | | |
|---|---|---|---|
| 6,956,728 | B2 | 10/2005 | Zhou et al. |
| 10,134,551 | B2 | 11/2018 | Potter et al. |

(Continued)

FOREIGN PATENT DOCUMENTS

| | | | |
|---|---|---|---|
| EP | 2474989 | A2 | 7/2012 |
| WO | 2010/035082 | A2 | 4/2010 |

(Continued)

OTHER PUBLICATIONS

Extended European Search Report dated Apr. 1, 2021, issued during the prosecution of European Patent Application No. 20211520.0.

*Primary Examiner* — Rexford N Barnie
*Assistant Examiner* — Xuan Ly
(74) *Attorney, Agent, or Firm* — Locke Lord LLP; Joshua L. Jones; Scott D. Wofsy

(57) ABSTRACT

A system includes a mechanical switching device having a first moveable contact operatively connected to selectively contact a first static contact. A second moveable contact is operatively connected to selectively contact a second static contact that is electrically connected in parallel with the first static contact. The first and second moveable contacts are mechanically connected to each other to move between a closed circuit position and an open circuit position. The first moveable contact contacts the first static contact before the second moveable contact contacts the second static contact as the first and second moveable contacts move into the closed circuit position from the open circuit position. The first moveable contact disconnects from the first static contact after the second moveable contact disconnects from the second static contact as the first and second moveable contacts move from the closed circuit position into the open circuit position.

8 Claims, 3 Drawing Sheets

(52) U.S. Cl.
CPC . *H01H 2201/024* (2013.01); *H01H 2225/008* (2013.01); *H01H 2225/018* (2013.01)

(56) References Cited

U.S. PATENT DOCUMENTS

| | | | | |
|---|---|---|---|---|
| 10,141,145 | B2 | 11/2018 | Tanaka et al. | |
| 11,195,671 | B2 * | 12/2021 | Belisle | H01H 1/2025 |
| 2004/0118237 | A1 * | 6/2004 | Kato | F16H 61/24 74/473.3 |
| 2008/0073327 | A1 * | 3/2008 | Annis | H01H 9/446 218/36 |
| 2019/0066939 | A1 * | 2/2019 | Johansson | H01H 9/383 |

FOREIGN PATENT DOCUMENTS

| | | | |
|---|---|---|---|
| WO | 2017059910 | A1 | 4/2017 |
| WO | 2018086366 | A1 | 5/2018 |

* cited by examiner

DUAL PARALLEL MOVEABLE ELECTRICAL CONTACTS/RELAYS

CROSS-REFERENCE TO RELATED APPLICATIONS

This application is a continuation of U.S. patent application Ser. No. 16/701,568, filed on Dec. 3, 2019, the entire content of which is incorporated herein by reference.

BACKGROUND

1. Field

The present disclosure relates to switching devices, and more particularly to electrical contactors or relays.

2. Description of Related Art

In traditional switching devices, the electrical contact functions as the material surface for the closing arc (while closing the electrical circuit), for current carrying (while the circuit is closed), and for opening (breaking the current flow when opening the circuit). The material properties for such electrical contacts that provide good arc resistance are traditionally in conflict with the material properties that provide low contact resistance (low voltage drop). Electrical contact arc erosion contributes to increased voltage drop and increased heating due to current flow.

The conventional techniques have been considered satisfactory for their intended purpose. However, there is an ever present need for improved systems and methods for electrical contactors/relays. This disclosure provides a solution for this need.

SUMMARY

A mechanical switching system includes a first moveable contact operatively configured to selectively contact a first static contact. A second moveable contact is electrically connected in parallel with the first moveable contact and is operatively configured to selectively connect a second static contact that is electrically connected in parallel with the first static contact. The first and second moveable contacts are mechanically connected to each other to move the mechanical switching system between a closed circuit position defined the second movable being in contact with the second static contact, and an open circuit position defined by both the first movable contact being disconnected from the first static contact and the second movable contact being disconnected from the second static contact. The first moveable contact contacts the first static contact before the second moveable contact contacts the second static contact as the mechanical switching system is moved from the open circuit position to the closed circuit position. The first moveable contact disconnects from the first static contact after the second moveable contact disconnects from the second static contact as the mechanical switching system is moved from the closed circuit position into the open circuit position.

An actuator can be mechanically connected to the first and second moveable contacts, wherein in the open circuit position, the first moveable contact is separated from the first static contact by a first gap that is smaller than a second gap separating the second moveable contact from the second static contact in the open circuit position. A first spring can mechanically connect between the first moveable contact and the actuator, wherein the first spring is configured to accommodate continued stroke of the actuator moving the second moveable contact after the first moveable contact contacts the first static contact. A second spring can mechanically connect between the second moveable contact and the actuator, wherein the second spring is configured to accommodate continued stroke of the actuator moving after the second moveable contact contacts the second static contact. The first and second static contacts and the first and second moveable contacts can all be on one side of the actuator. The actuator can be a commandable actuator configured to actuate between the open and closed circuit positions based on input. The actuator can include a solenoid motor.

The first moveable contact can include two separate electrical contact points, and the first static contact can include two respective contact points aligned for contacting the two separate electrical contact points of the first moveable contact. The second moveable contact can include two separate electrical contact points, and the second static contact can include two respective contact points aligned for contacting the two separate electrical contact points of the second moveable contact.

The first moveable contact and the first static contact can include respective contact points of a first contactor material that is different from a second contactor material included in respective contact points of the second moveable contact and the second static contact. The first contactor material can have a higher arc resistance than that of the second contactor material. The second contactor material can provide a lower voltage drop than that of the first contactor material. The contacts are configured such that when the mechanical switching system is in the closed circuit position a first resistance across the first contacts is more than a second resistance across the second contacts.

A method includes closing a circuit by first contacting a first static contact with a first moveable contact, wherein an electrical arc forms between the first static contact and the first moveable contact before they contact one another. The method includes then contacting a second static contact with a second moveable contact, wherein no electrical arc forms between the second static contact and the second moveable contact, the first contacts and the second contacts being electrically in parallel when the circuit is closed.

The method can include flowing more current through the closed circuit through the second moveable contact and the second static contact than through the first moveable contact and the first static contact. The method can include opening the circuit by first separating the second moveable contact from the second static contact wherein no electrical arc forms between the second static contact and the second moveable contact; and then separating the first moveable contact from the first static contact, wherein an electrical arc forms between the first static contact and the first moveable contact after they separate from one another. The method can include conducting current from the first moveable contact to the first static contact in parallel with current conducted from the second moveable contact to the second static contact after closing the circuit and before opening the circuit.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
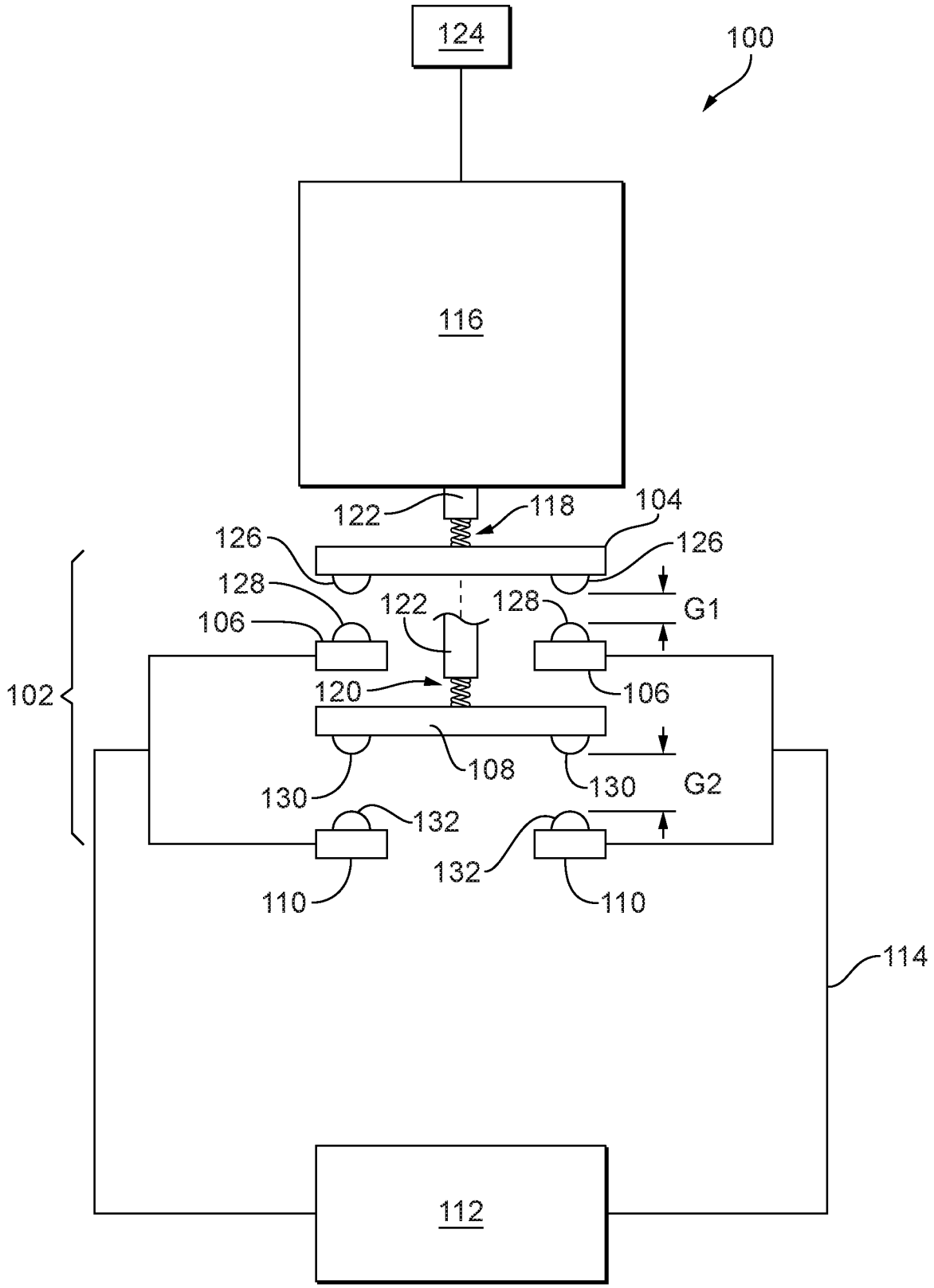
FIG. 1 is a schematic side elevation view of an embodiment of a system constructed in accordance with the present disclosure, showing the actuator and electrically parallel contact connections.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-6, as will be described. The systems and methods described herein can be used to for switching power with improved performance relative to traditional techniques. Those skilled in the art will readily appreciate that while disclosed below in the context of contacts and contactors, relays can also be used without departing from the scope of this disclosure.

The system 100 includes a mechanical switching device 102 (e.g., a relay or contactor) having a first moveable contact 104 operatively connected to selectively contact a first static contact 106. A second moveable contact 108 is operatively connected to selectively contact a second static contact 110 that is electrically connected in parallel to the circuit 112 with the first static contact 106, as indicate by the circuit lines 114 in FIG. 1. The first and second moveable contacts 104, 108 are mechanically connected to each other to move back and forth between a closed circuit position, shown in FIG. 5, and an open circuit position shown in FIG. 2.

With continued reference to FIG. 1, an actuator 116 is mechanically connected to the first and second moveable contacts 104, 108 by a mechanical element 122. In the open circuit position, shown in FIGS. 1 and 2, the first moveable contact 104 is separated from the first static contact 106 by a first gap G1 that is smaller than a second gap G2 separating the second moveable contact 108 from the second static contact 110 in the open circuit position (i.e. G1<G2). A first spring 118 or other resilient member mechanically connects between the first moveable contact 104 and the actuator 116. The first spring 118 is configured to accommodate continued stroke of the actuator 116 moving the second moveable contact 108 after the first moveable contact 104 contacts (electrically connects) the first static contact 106 (while the system 100 moves from the state shown in FIG. 4 to the state shown in FIG. 5). A second spring 120 mechanically connects between the second moveable contact 108 and the actuator 116. The second spring is configured to accommodate continued stroke of the actuator 116 moving after the second moveable contact 108 contacts (electrically connects) the second static contact 110. The first and second static contacts 106, 110 and the first and second moveable contacts 104, 108 can all be on one side of the actuator 116 e.g., connected to the actuator 116 by a mechanical element 122 shown partially in FIG. 1 for sake of clarity. The actuator 116 can be a commandable actuator configured to actuate between the open and closed circuit positions based on input, e.g. the actuator 116 can include a solenoid motor connected to a controller 124 to open and close the circuit 112 as needed.

The first moveable contact 104 includes two separate electrical contact points 126, and the first static contact 106 includes two respective contact points 128 aligned for contacting the two separate electrical contact points 126. The second moveable contact 108 includes two separate electrical contact points 130. The second static contact 110 includes two respective contact points 132 aligned for contacting the two separate electrical contact points 130. The contact points 126 and 128 are of a first contactor material and the contact points 130, 132 are of a second contactor material. The first contactor material has a higher arc resistance than that of the second contactor material. The second contactor material, such as a high silver content alloy relative to the first contactor material, provides a lower voltage drop than that of the first contactor material.

Figure 3:
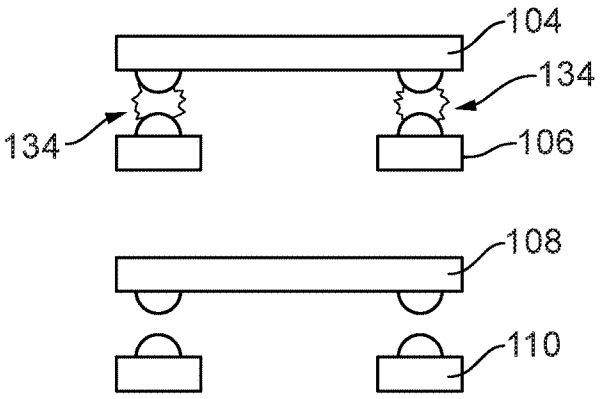
FIGS. 2-5 are schematic side elevations views of a portion of the system of FIG. 1, showing the open circuit position, electrical arc during opening/closing, during closing/opening with the first contacts closed and the second contacts open, and in the closed circuit position, respectively.
Figure 4:
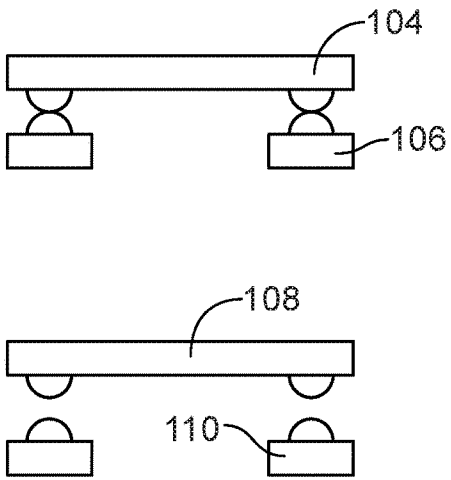
Figure 5:
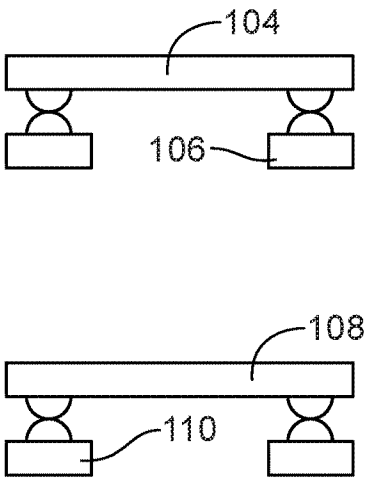
Figure 2:
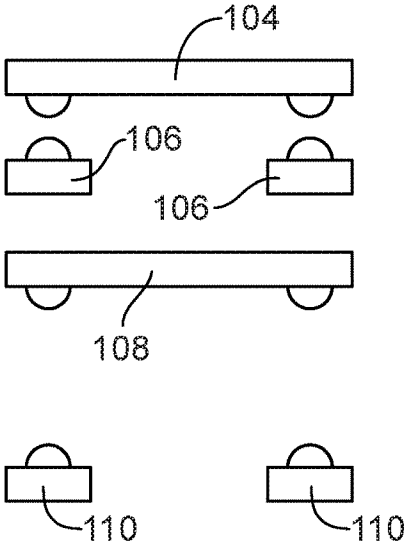

With reference now to FIGS. 2-5, a method includes closing a circuit (e.g. circuit 112 of FIG. 1) starting from an open circuit position as shown in FIG. 2 by first contacting a first static contact 106 with a first moveable contact 104. Electrical arcs 134 forms between the first static contact 106 and the first moveable contact 104 as they contact one another as shown in FIG. 3. After the first contacts 104, 106 are closed, the second movable contact 108 contacts the second static contact 110. In FIG. 4, electrical current flows between the first static contact 106 and the first moveable contact 104. Then when the second contacts 108, 110 contact each other there is no arc because of negligible voltage drop across the second parallel contacts 108, 110, and the system 100 is in the fully closed circuit position shown in FIG. 5.

The method can include opening the circuit 112 of FIG. 1, (going again through FIGS. 2-5 but in reverse order, starting in the closed circuit position of FIG. 5) by first separating the second moveable contact 108 from the second static contact 110 wherein no electrical arc forms between the second static contact 110 and the second moveable contact 108 as shown in FIG. 4. The method then includes separating the first moveable contact 104 from the first static contact 106, wherein an electrical arc 134 forms between the first static contact 106 and the first moveable contact 104 after they separate from one another, as shown in FIG. 3, and after continuing to separate the first contacts, 106, the system returns to the fully circuit open position shown in FIG. 2. Whether opening or closing, there is no electrical arc in the position shown in FIG. 4 due to the current flowing through the first contacts 104, 106 connected electrically in parallel with the second contacts 108, 110 after closing the circuit 112 and before opening the circuit 112 of FIG. 1.

Figure 6:
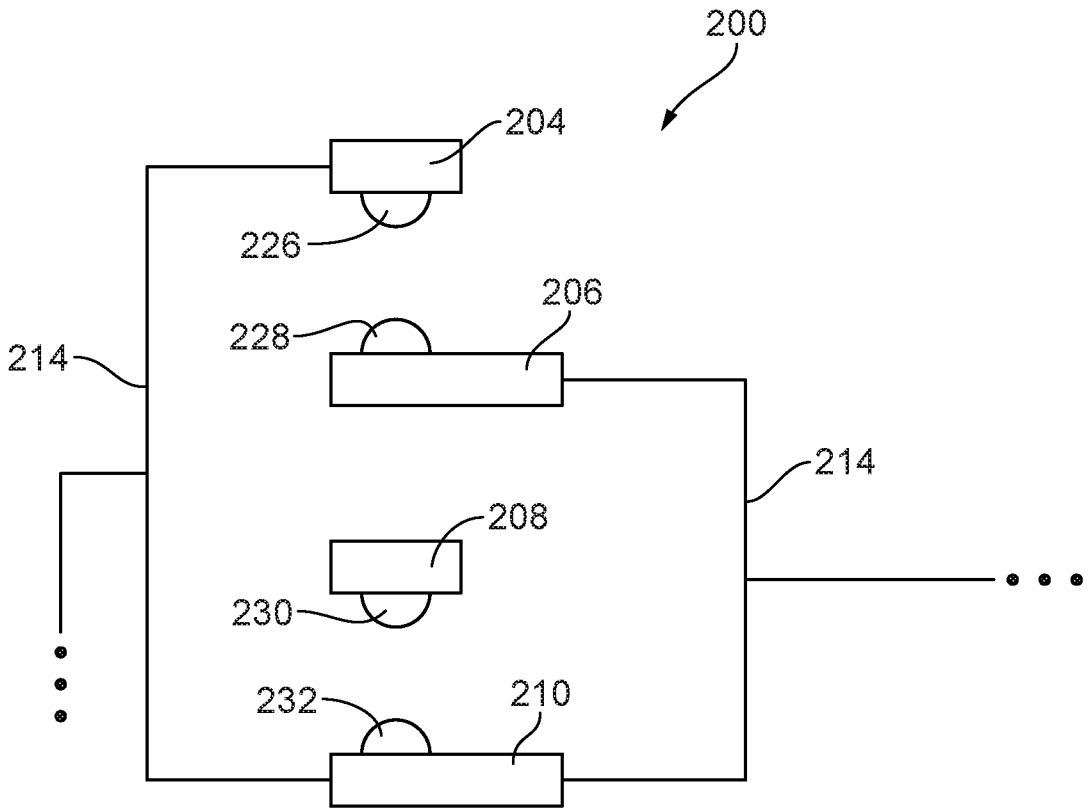
FIG. 6 is a schematic side elevation view of a system similar to that of FIG. 1 but with single parallel contacts rather than dual parallel contacts.

With reference now to FIG. 6, the system 100 described above has dual parallel contact points 126, 128, 130, 132. However it is also contemplated that single parallel contact points can also be used as in System 200. System 200 has a first moveable contact 204 and a first static contact 206 with respective single contact points 226 and 228, and a second moveable contact 208 second static contact 210 with respective single contact points 230 and 232. The contacts 204, 206, 208, 210 are electrically connected in parallel as indicated by circuit lines 214, and can be mechanically connected to an actuator in the same matter described above with reference to FIG. 1.

The methods and systems of the present disclosure, as described above and shown in the drawings, provide for contacts/relays with improved arc resistance, voltage drop, and useable life time than in traditional configurations. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A mechanical switching system comprising:

a first moveable contact operatively configured to selectively contact a first static contact; and a second moveable contact that is electrically connected in parallel with the first moveable contact and operatively configured to selectively connect a second static contact that is electrically connected in parallel with the first static contact, wherein the first and second moveable contacts are mechanically connected to each other to move the mechanical switching system between a closed circuit position defined by the second movable being in contact with the second static contact, and an open circuit position defined by both the first movable contact being disconnected from the first static contact and the second movable contact being disconnected from the second static contact, wherein the first moveable contact contacts the first static contact before the second moveable contact contacts the second static contact as the mechanical switching system is moved from the open circuit position to the closed circuit position, wherein the first moveable contact disconnects from the first static contact after the second moveable contact disconnects from the second static contact as the mechanical switching system is moved from the closed circuit position into the open circuit position, wherein the first moveable contact and the first static contact include respective contact points of a first material that is different from a second material included in respective contact points of the second moveable contact and the second static contact, and wherein the second material provides a lower voltage drop than that of the first material, further comprising an actuator mechanically connected to the first and second moveable contacts, wherein in the open circuit position, the first moveable contact is separated from the first static contact by a first gap that is smaller than a second gap separating the second moveable contact from the second static contact in the open circuit position, wherein a first spring mechanically connects between the second moveable contact and the actuator, wherein the first spring is configured to accommodate continued stroke of the actuator moving after the second moveable contact contacts the second static contact.

2. The system as recited in claim 1, wherein a second spring mechanically connects between the first moveable contact and the actuator, wherein the second spring is configured to accommodate continued stroke of the actuator moving the second moveable contact after the first moveable contact contacts the first static contact.

3. The system as recited in claim 1, wherein the first and second static contacts and the first and second moveable contacts are all on one side of the actuator.

4. The system as recited in claim 1, wherein the actuator is a commandable actuator configured to actuate between the open and closed circuit positions based on input.

5. The system as recited in claim 4, wherein the actuator includes a solenoid motor.

6. The system as recited in claim 1, wherein the first moveable contact includes two separate electrical contact points, and wherein the first static contact includes two respective contact points aligned for contacting the two separate electrical contact points of the first moveable contact.

7. The system as recited in claim 1, wherein the second moveable contact includes two separate electrical contact points, and wherein the second static contact includes two respective contact points aligned for contacting the two separate electrical contact points of the second moveable contact.

8. The system as recited in claim 1, wherein the contacts are configured such that when the mechanical switching system is in the closed circuit position a first resistance across the first contacts is more than a second resistance across the second contacts.

* * * * *